US011344114B2

(12) United States Patent
Li

(10) Patent No.: US 11,344,114 B2
(45) Date of Patent: May 31, 2022

(54) SHELF

(71) Applicants: HANGZHOU UNITED TOOLS CO., LTD., Hangzhou (CN); HANGZHOU GREAT STAR INDUSTRIAL CO., LTD., Hangzhou (CN)

(72) Inventor: Yueming Li, Hangzhou (CN)

(73) Assignees: Hangzhou United Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 518 days.

(21) Appl. No.: 16/345,836

(22) PCT Filed: Mar. 12, 2018

(86) PCT No.: PCT/CN2018/078678
§ 371 (c)(1),
(2) Date: Apr. 29, 2019

(87) PCT Pub. No.: WO2019/173935
PCT Pub. Date: Sep. 19, 2019

(65) Prior Publication Data

US 2021/0368977 A1 Dec. 2, 2021

(51) Int. Cl.

| | |
|---|---|
| ***A47B 47/02*** | (2006.01) |
| ***A47B 47/00*** | (2006.01) |
| ***A47B 96/14*** | (2006.01) |

(52) U.S. Cl.
CPC ..... *A47B 47/027* (2013.01); *A47B 47/0083* (2013.01); *A47B 96/1408* (2013.01)

(58) Field of Classification Search
CPC ..... A47B 47/027; A47B 47/0083; A47B 96/1408; A47B 47/00; A47F 5/00; A47F 1/00
See application file for complete search history.

(56) References Cited

U.S. PATENT DOCUMENTS

RE24,535 E * 9/1958 Franks ..... A47B 57/402 211/191
2,925,920 A * 2/1960 Skubic ..... A47B 57/402 108/107

(Continued)

FOREIGN PATENT DOCUMENTS

CN 203608484 U 5/2014
CN 104323590 A 2/2015

(Continued)

*Primary Examiner* — Stanton L Krycinski
(74) *Attorney, Agent, or Firm* — Blank Rome LLP

(57) ABSTRACT

The present invention discloses a shelf comprising a plurality of cross beams, a plurality of support portions and at least one rest portion. Each of the cross beams is connected to a corresponding support portion by a connector, and a side face of each of the cross beams has a rest face for placement of a corresponding rest portion. At least two opposite ends of the rest portion are arranged on the rest faces, in the same plane, of at least two corresponding cross beams. The plurality of cross beams and the plurality of support portions are profiles formed by die extrusion-stretching. Compared with a traditional shelf, the shelf according to the present invention has the advantages of light weight, having less tendency to rust and corrode, being easy to disassemble and assemble, being free of stress concentration problem, and the like.

7 Claims, 2 Drawing Sheets

(56) References Cited

U.S. PATENT DOCUMENTS 2,950,826 A * 8/1960 Degener ..... A47B 57/402 211/191
3,042,221 A * 7/1962 Rasmussen ..... A47B 57/50 211/183
3,048,245 A * 8/1962 Earlw ..... F16B 7/22 403/190
3,846,944 A * 11/1974 Lambert ..... A47B 47/021 52/236.3
3,862,691 A * 1/1975 Mori ..... A47B 57/40 211/191
4,201,139 A * 5/1980 Suttles ..... A47B 57/40 108/109
4,342,397 A * 8/1982 Halstrick ..... F16B 7/22 211/191
4,379,431 A * 4/1983 Clement ..... A47F 5/101 108/1
4,665,838 A * 5/1987 Minshall ..... A47B 47/021 108/157.13
4,801,026 A * 1/1989 Andersson ..... A47B 96/00 211/183
4,955,490 A * 9/1990 Schafer ..... A47B 57/581 211/187
5,012,938 A * 5/1991 King ..... A47B 47/027 211/182
5,279,431 A * 1/1994 Highsmith ..... B65G 1/02 211/187
5,628,415 A * 5/1997 Mulholland ..... A47B 47/027 211/186
5,749,481 A * 5/1998 Miller ..... A47B 47/021 211/187
6,105,798 A * 8/2000 Gruber ..... B65G 1/023 211/151
6,450,350 B1 * 9/2002 Krummell, Jr. ..... A47B 47/027 211/183
6,510,955 B2 * 1/2003 Pellegrino ..... F16B 7/0446 211/192
7,252,202 B2 * 8/2007 Saltzberg ..... A47B 57/50 211/187
7,614,511 B2 * 11/2009 Konstant ..... A47B 47/021 211/189
7,641,063 B2 * 1/2010 Wishart ..... A47B 47/027 211/189
8,443,992 B2 * 5/2013 Lawson ..... A47B 47/028 211/190
8,672,150 B2 * 3/2014 Chen ..... A47B 57/50 211/187
8,695,816 B2 * 4/2014 Troyner ..... A47B 96/14 211/191
8,967,401 B2 * 3/2015 Wu ..... A47B 91/024 211/191
9,027,767 B2 * 5/2015 Buckley ..... A47B 47/0083 211/134
9,101,216 B2 * 8/2015 Fitzgerald ..... A47B 96/06
9,215,926 B1 * 12/2015 Offerman ..... A47B 47/02
9,215,931 B1 * 12/2015 Offerman ..... A47B 96/02
9,241,566 B1 * 1/2016 Chen ..... A47B 47/0083
9,301,610 B1 * 4/2016 Berry ..... A47B 57/34
9,375,102 B2 * 6/2016 Troyner ..... A47B 57/402
9,386,855 B2 * 7/2016 Sabounjian ..... A47B 96/14
9,474,369 B1 * 10/2016 Tsai ..... A47F 5/10
9,493,177 B1 * 11/2016 Chen ..... B62B 3/005
9,661,921 B1 * 5/2017 Tsai ..... A47B 47/0083
9,713,378 B1 * 7/2017 Tsai ..... A47B 87/0215
9,713,379 B1 * 7/2017 Tsai ..... A47B 47/0083
9,723,925 B1 * 8/2017 Tsai ..... A47B 47/00
9,993,075 B2 * 6/2018 Buckley ..... A47B 57/34
9,999,301 B2 * 6/2018 Stauffer ..... A47B 47/021
10,299,593 B2 * 5/2019 Bruckner ..... A47B 47/021
10,299,594 B2 * 5/2019 Liss ..... A47B 55/00
10,376,047 B1 * 8/2019 Ebbesson ..... A47B 57/50
10,729,245 B2 * 8/2020 Wang ..... A47B 57/06
10,806,251 B2 * 10/2020 Liss ..... A47B 47/021
10,806,257 B1 * 10/2020 Liu ..... A47B 47/024
11,006,750 B2 * 5/2021 Chiu ..... A47B 96/06
11,019,921 B2 * 6/2021 Liss ..... A47B 55/02
11,026,509 B2 * 6/2021 Walker ..... A47B 96/1416
11,039,686 B2 * 6/2021 Min ..... A47B 96/068
11,084,622 B2 * 8/2021 Brumm ..... B65G 1/02
2005/0103733 A1 * 5/2005 Saltzberg ..... A47B 96/1441 211/187
2005/0103734 A1 * 5/2005 Saltzberg ..... A47B 96/1441 211/187
2008/0272676 A1 * 11/2008 Eustace ..... A47B 47/0083 312/243
2009/0277854 A1 * 11/2009 Eustace ..... B25H 1/02 211/86.01
2010/0084354 A1 * 4/2010 Eustace ..... A47B 96/1441 211/134
2011/0042336 A1 * 2/2011 Cheng ..... A47B 96/02 211/153
2011/0272373 A1 * 11/2011 Wojtowicz ..... A47F 5/14 211/134
2011/0272541 A1 * 11/2011 Wojtowicz ..... A47B 87/0215 248/218.4
2011/0272542 A1 * 11/2011 Wojtowicz ..... A47F 5/14 248/218.4
2012/0000872 A1 * 1/2012 Troyner ..... A47B 57/00 211/150
2012/0000873 A1 * 1/2012 Fitzgerald ..... A47B 96/1441 211/153
2013/0240471 A1 * 9/2013 Wiese ..... A47B 57/50 211/134
2015/0090683 A1 * 4/2015 Sabounjian ..... A47B 47/028 211/186
2015/0282613 A1 * 10/2015 Chen ..... A47B 96/1408 211/187
2015/0313357 A1 * 11/2015 David ..... A47B 57/20 211/187
2015/0359330 A1 * 12/2015 Offerman ..... A47B 47/03 211/186
2016/0051044 A1 * 2/2016 Sabounjian ..... A47B 47/021 211/186
2017/0208947 A1 * 7/2017 Tsai ..... A47B 47/0083
2017/0211604 A1 * 7/2017 Tsai ..... A47B 47/0083
2017/0238702 A1 * 8/2017 Tsai ..... A47B 57/50
2017/0238703 A1 * 8/2017 Tsai ..... A47B 47/0083
2017/0238704 A1 * 8/2017 Tsai ..... A47B 47/0083
2017/0280875 A1 * 10/2017 Buckley ..... A47B 47/021
2018/0084912 A1 * 3/2018 Yu ..... A47B 47/021
2019/0029416 A1 * 1/2019 Lu ..... A47B 57/482
2019/0208904 A1 * 7/2019 Yu ..... A47B 57/581
2019/0290000 A1 * 9/2019 Davis ..... A47B 57/34
2021/0321763 A1 * 10/2021 Wang ..... A47B 47/0083

FOREIGN PATENT DOCUMENTS

CN 104510179 A 4/2015
CN 205667463 U 11/2016
EP 2589315 A1 * 5/2013 ..... A47B 47/028
GB 2211906 A * 7/1989 ..... G09F 15/0068
JP 2017-051401 A 3/2017
KR 20100132853 A * 12/2010
KR 20140001930 U * 4/2014
KR 200473407 Y1 * 7/2014
WO WO-2006043898 A1 * 4/2006 ..... A47B 47/0083
WO WO-2020204860 A1 * 10/2020 ..... A47B 47/028
WO WO-2020219500 A1 * 10/2020 ..... A47B 47/0083
WO WO-2020219505 A1 * 10/2020 ..... A47B 57/50

* cited by examiner

Drawings of the Description

SHELF

CROSS-REFERENCE TO RELATED APPLICATIONS

This application is a National Stage of PCT/CN2018/078678, filed Mar. 12, 2018, all of which is incorporated herein by reference in its entirety.

FIELD OF THE INVENTION

The present invention relates to the field of logistics and warehousing technology, and in particular to a shelf that can be applied in the logistics and warehousing industries.

DESCRIPTION OF THE PRIOR ART

At present, common shelves are iron shelves, but iron shelves are generally heavy and difficult to move and handle. Moreover, the disassembly and assembly of such iron shelves is time consuming and laborious, and the iron shelves are prone to corrosion and rust. On the other hand, methods for processing a cross beam and a column face of an iron shelf body may be classified into two types. The first processing method is to form the cross beam and the column face by bending the entire plate through multiple procedures. The second processing method is to weld a plurality of plates to form the cross beam and the column face. However, with these two processing methods, there is a problem of stress concentration at both a bending portion and a welding point of the plate, which affects the service life of the plate and even of the shelf. Furthermore, for a bending piece, its shape cannot be too complicated due to process limitations, and its wall thickness, transition fillet, etc. are also greatly affected by process limitations; moreover, the plate of the bending piece is generally of equal thickness. Therefore, for the bending piece, a locally thickened feature cannot be formed thereon, and thus targeted thickness processing cannot be performed thereon on the basis of the force to which it is actually subjected.

SUMMARY OF THE INVENTION

In view of the above drawbacks of the prior art, the technical problem to be solved by the present invention is to provide a shelf that is lightweight, resistant to rust and corrosion, easy to disassemble and assemble, and free of stress concentration problem.

To achieve the above object, the present invention provides a shelf that comprises a plurality of cross beams, a plurality of support portions, and at least one rest portion. Each of the cross beams is connected to a corresponding support portion by a connector, and a side face of each of the cross beams has a rest face for placement of a corresponding rest portion. At least two opposite ends of the rest portion are arranged on rest faces, in the same plane, of at least two corresponding cross beams. The plurality of cross beams and the plurality of support portions are profiles formed by die extrusion-stretching.

Preferably, the profile is an aluminum alloy profile, a magnesium alloy profile, an aluminum-magnesium alloy profile, or a titanium alloy profile.

Preferably, the contact face where the cross beam contacts with the support portion, the bending portion of the profile, the fillet of the profile, or the place where the profile is subjected to stress are thickened so that the mechanical strength and bending resistance of the profile are improved.

Preferably, the cross beam has a recessed structure, of which the cross-sectional shape comprises an "L" shape, an "inverted T" shape, or a "cross" shape.

Preferably, a bottom face of the rest face of the cross beam is connected with a first support face and a second support face; and the first support face and the second support face intersect to form a "y" shape.

Preferably, the side face of the cross beam is further provided with a reinforcing plate fixation face below the rest face; a bottom face of the rest face is connected with a first arc-shaped face and a second arc-shaped face above the reinforcing plate fixation face; and the first arc-shaped face and the second arc-shaped face intersect to form a "y" shape.

Preferably, the connector comprises a pin, a bolt, or a rivet.

Preferably, the support portion is provided with a plurality of through-holes; when the support portion is normally upright, each of the through-holes is formed by connecting one large hole and one small hole from up to down; the two ends of each of the cross beams are connected and fixed to the connector through connection holes; and the diameter of a head of the connector is smaller than the diameter of the large hole of the through-hole, but larger than the diameter of the small hole of the through-hole.

Preferably, the rest portion is a rectangular object made of a wooden plate, an iron plate, a wire mesh, or a plastic.

Preferably, a reinforcing plate perpendicular to the cross beams is provided between at least two opposite cross beams; and the reinforcing plate is connected and fixed to the cross beam by pins or bolts.

The concepts, specific structures, and resulting technical effects of the present invention will be further described below with reference to the accompanying drawings to fully understand the objects, features, and effects of the present invention.

DETAILED DESCRIPTION OF THE PREFERRED EMBODIMENTS

Figure 1:
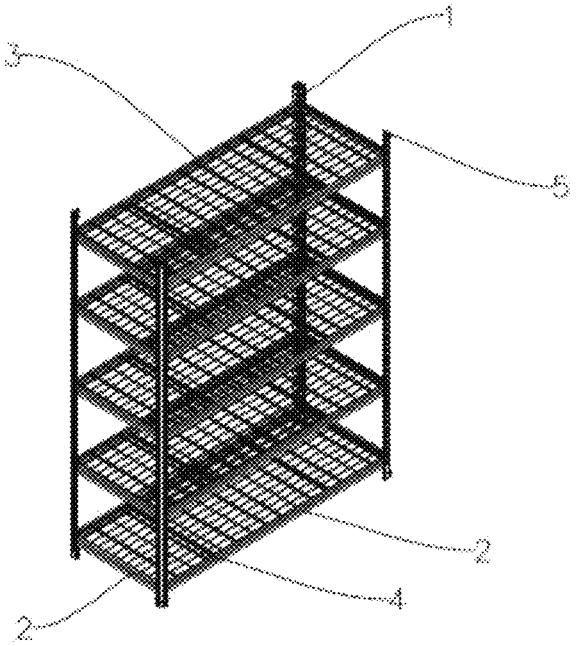
FIG. 1 is a schematic view of a shelf according to a preferred implementation mode of the present invention.

Hereinafter, a plurality of preferred embodiments of the present invention will be described with reference to the accompanying drawings of the specification to make its technical content more clear and easy to understand. The present invention may be embodied by many different forms of embodiments, and the scope of the present invention is not only limited to the embodiments mentioned herein.

In the accompanying drawings, components having the same structure are denoted by the same reference numeral, and assemblies having similar structures or functions in various places are denoted by similar reference numerals. The size and thickness of each assembly shown in the accompanying drawings are arbitrarily shown, and the present invention does not limit the size and thickness of each assembly. To make the illustration more clear, the thickness of the component is properly exaggerated at some places of the accompanying drawings.

Figure 2:
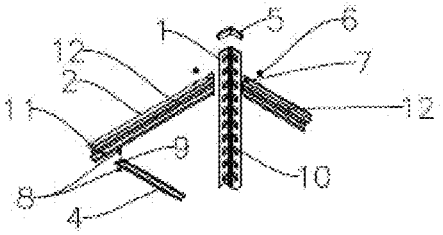
FIG. 2 is an exploded schematic view of a junction of the shelf shown in FIG. 1.

As shown in FIGS. 1 and 2, a shelf according to a preferred implementation mode of the present invention comprises a plurality of support portions 1, a plurality of cross beams 2, at least one rest portion 3, and an optional reinforcing plate 4 and sheath 5. Among them, the cross beams 2 are generally arranged in pairs. In one layer of the shelf, only one pair of mutually opposite cross beams 2 may be provided, or two pairs of mutually opposite cross beams 2 may be provided at the same time. Since the force to which each part of the cross beam 2 is subjected is not the same, if the cross beam 2 is made of a profile and the profile is formed by die extrusion-stretching, the wall thickness of the cross beam 2 may be changed on the basis of the force to which the cross beam 2 is actually subjected, achieving dual effects of reducing the weight of the cross beam 2 and increasing the bearing capacity of the cross beam 2. Meanwhile, because the profile forming the cross beam 2 is formed by die extrusion-stretching rather than formed by a bending or welding process, there is no stress concentration problem, thereby prolonging its service life. For similar reasons, in a preferred implementation mode according to the present invention, the support portion 1 is also made of a profile formed by die extrusion-stretching.

In order to enable the connection and fixation between the support portion 1 and the cross beam 2, in the implementation modes shown in FIGS. 1 and 2, the support portion 1 is provided with through-holes 10 thereon. As can be seen from FIGS. 1 and 2, in the case where the support portion 1 is normally upright, each of the through-holes 10 is formed by connecting one large hole and one small hole from up to down. Two ends of the cross beam 2 are connected and fixed to rivets 6 through connection holes 7 provided the two ends. The diameter of a head of the rivet 6 is set to be smaller than the diameter of the large hole of the through-hole 10 but larger than the diameter of the small hole of the through-hole 10. When the rivet 6 connected with the cross beam 2 is placed within the large hole of the corresponding through-hole 10 of the support portion 1, since the diameter of the head of the rivet 6 is smaller than the diameter of the large hole of the through-hole 10, the rivet 6 will slide downward into the small hole of the through-hole 10 under gravity. Since the diameter of the head of the rivet 6 is larger than the diameter of the small hole of the through-hole 10, the rivet 6 will be caught by the small hole of the through-hole 10, so that the cross beam 2 is connected and fixed to the support portion 1. It would be easily understood by those skilled in the art that in addition to the rivets 6, other connectors such as pins, bolts, etc. may be used to connect and fix the support portion 1 to the corresponding cross beam 2. For example, when bolts are employed for connection and fixation, the support portion 1 may be connected and fixed to the cross beam 2 directly by bolts.

In order to place the rest portion 3 in the shelf, as shown in FIG. 2, a rest face 12 may be provided on the side face of the cross beam 2, and the rest faces 12 of at least two opposite cross beams 2 are in the same plane. Thus, at least two opposite ends of any of the rest portions 3 may be arranged on the rest faces 12, in the same plane, of at least two corresponding cross beams 2. The rest portion 3 may be, for example, a rectangular object made of a wooden plate, an iron plate, a wire mesh, or a plastic (for example, PC).

Furthermore, as shown in FIGS. 1 and 2, a reinforcing plate 4 perpendicular to the cross beam 2 may be further provided between the at least two opposite cross beams 2. Connection holes 9 are provided on both ends of the reinforcing plate 4, and connection holes 11 are correspondingly provided on two ends of the cross beams 2. Therefore, the connection holes 11 on the cross beams 2 and the corresponding connection holes 9 on the reinforcing plate 4 may be connected by, for example, bolts and nuts 8, so that the cross beams 2 are connected and fixed to the corresponding reinforcing plate 4. Of course, it would also be apparent to those skilled in the art that the connection holes 11 on the cross beams 2 and the connection holes 9 on the reinforcing plate 4 may also be connected by other connectors such as pins so that the cross beams 2 are connected and fixed to the corresponding reinforcing plate 4.

In addition, in the shelves shown in FIGS. 1 and 2, in order to perform necessary protection for the support portion 1, sheaths 5 are provided at both ends of each support portion 1 that might be easily worn, and a groove conforming to a cross-sectional shape of the end of the support portion 1 is provided within the sheath 5. The sheath 5 may be made of, for example, a plastic.

Next, the support portion 1 and the cross beam 2 employed in the shelf according to the present invention will be further described with reference to the accompanying drawings.

As shown in FIGS. 1, 2, 5, and 6, a cross section of a profile of a support portion 1 that can be employed in the shelf according to the present invention has an "L" shape. However, it would be easily understood by those skilled in the art that the cross-sectional shape of the profile of the support portion 1 is not limited thereto. In fact, as a non-limiting example, the cross section of the profile of the support portion 1 may also have an "inverted T" shape, a "cross" shape, or other possible shapes.

Figure 3:
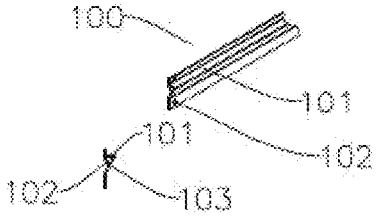
FIG. 3 is a schematic view of a cross beam structure 100 that can be employed in the shelf according to the present invention.

As shown in FIG. 3, there is shown a cross beam profile structure 100 that can be employed in the shelf according to the present invention. The side face of the cross beam profile structure 100 is provided with a rest face 101, and the bottom face of the rest face 101 is connected with a support face 102 and a support face 103, and the support face 102 and the support face 103 intersect to form a "y" shape.

Figure 4:
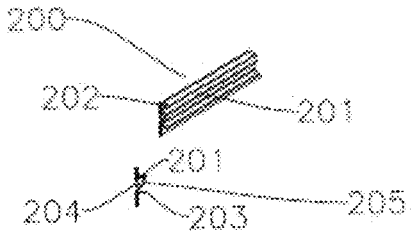
FIG. 4 is a schematic view of another cross beam structure 200 that can be employed in the shelf according to the present invention.
Figure 5:
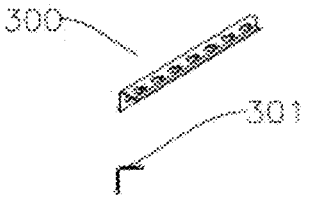
FIG. 5 is a schematic view of a support portion structure 300 that can be employed in the shelf according to the present invention.
Figure 6:
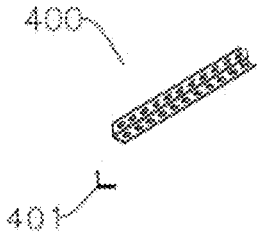
FIG. 6 is a schematic view of another support portion structure 400 that can be employed in the shelf according to the present invention.

As shown in FIG. 4, there is shown another cross beam profile structure 200 that can be employed in the shelf according to the present invention. The side face of the cross beam profile structure 200 is provided with a rest face 201 and a reinforcing plate fixation face 203 below the rest face 201. A bottom face of the rest face 201 is connected with arc-shaped faces 204 and 205 above the reinforcing plate fixation face 203, and the two arc-shaped faces 204 and 205 intersect to form a "y" shape.

Moreover, the inventor also noticed that when the cross beam has a recessed structure and the cross-sectional shape of the recessed structure comprises an "L" shape, an "inverted T" shape, or a "cross" shape, a better technical effect may be obtained.

The profile that may be used as the support portion 1 and the cross beam 2 is preferably an aluminum alloy profile. In other implementation modes, the profile that may be used as the support portion 1 and the cross beam 2 may also be a magnesium alloy profile, an aluminum-magnesium alloy profile, even a titanium alloy profile, and so on.

As a result of the use of a profile to manufacture of the support portion 1 and the cross beam 2, thickening processing may be performed at the contact face where the cross beam 2 contacts with the support portion 1, at the bending portion of the profile, at the fillet of the profile, or at the place where the profile is subjected to stress, so that the mechanical strength and bending resistance of the profile and thus of the shelf are improved.

In a preferred implementation mode, an aluminum alloy profile may also be selected to form the reinforcing plate 4 to reduce the overall weight of the shelf and facilitate mobility.

It can be seen from the above description that the following beneficial effects may be obtained by adopting the technical solutions of the present invention: 1. the weight of the shelf is obviously reduced as compared with the traditional shelf; 2. the shelf is easy to assemble and disassemble, and has less tendency to corrode and rust; 3. the shelf is free of stress concentration problem existing in the traditional shelf caused by the bending or welding process, so its service life can be significantly improved; 4. the profile employed in the shelf has good consistency, and has various forms.

The preferred specific embodiments of the present invention has been described in detail above. It should be understood that many modifications and variations may be made by those of ordinary skill in the art according to the concepts of the invention without the exercise of inventive faculty. Therefore, any technical solutions that may be obtained by those skilled in the art by way of logical analysis, reasoning or limited experiments on the basis of the prior art and according to the concepts of the present invention should fall within the scope defined by the claims.

What is claimed is:

1. A shelf, comprising a plurality of cross beams, a plurality of support portions and at least one rest portion, each of the cross beams being connected to a corresponding support portion by a connector, a side face of each of the cross beams having a rest face for placement of a corresponding rest portion, at least two opposite ends of the rest portion being arranged on the rest faces, in the same plane, of at least two corresponding cross beams, characterized in that the plurality of cross beams and the plurality of support portions are profiles formed by die extrusion-stretching;

wherein a side face of the cross beam is further provided with a reinforcing plate fixation face below the rest face, a bottom face of the rest face is connected with a first arc-shaped face and a second arc-shaped face above the reinforcing plate fixation face, and the first arc-shaped face and the second arc-shaped face intersect to form a "y" shape.

2. The shelf according to claim 1, wherein the profile is an aluminum alloy profile, a magnesium alloy profile, an aluminum-magnesium alloy profile, or a titanium alloy profile.

3. The shelf according to claim 1, wherein a contact face where the cross beam contacts with the support portion, a bending portion of the profile, a fillet of the profile, or a place where the profile is subjected to stress are thickened so that a mechanical strength and a bending resistance of the profile are improved.

4. The shelf according to claim 1, wherein the connector comprises a pin, a bolt, or a rivet.

5. The shelf according to claim 1, wherein the support portion is provided with a plurality of through-holes 10, when the support portion is normally upright, each of the through-holes is formed by connecting one large hole and one small hole from up to down, two ends of each of the cross beams are connected and fixed to the connectors through connection holes provided on the two ends, a diameter of a head of the connector is smaller than a diameter of the large hole of the through-hole but larger than a diameter of the small hole of the through-hole.

6. The shelf according to claim 1, wherein the rest portion is a rectangular object made of a wooden plate, an iron plate, a wire mesh, or a plastic.

7. The shelf according to claim 1, wherein a reinforcing plate perpendicular to the cross beams is provided between at least two opposite cross beams, and the reinforcing plate is connected and fixed to the cross beam by pins or bolts.

* * * * *